United States Patent [19]

Cossin

[11] Patent Number: 4,968,029

[45] Date of Patent: Nov. 6, 1990

[54] TUMMY REDUCER

[76] Inventor: George E. Cossin, 627 E. Oleander Cir., Barefoot Bay, Fla. 32958

[21] Appl. No.: 203,819

[22] Filed: Jun. 8, 1988

[51] Int. Cl.[5] ..... A63B 3/00

[52] U.S. Cl. ..... 272/145

[58] Field of Search ..... 272/144, 93, 145, 97, 272/94, 146, 96, 1 B; 128/25 B; 441/70

[56] References Cited

U.S. PATENT DOCUMENTS

| | | | |
|---|---|---|---|
| 2,245,331 | 6/1941 | Dawley | 272/145 |
| 2,533,273 | 12/1950 | MacGregor | 272/144 |
| 2,759,730 | 8/1956 | Berry | 272/145 |
| 3,203,016 | 8/1965 | Miller et al. | 441/70 |
| 3,286,708 | 11/1966 | Gartner | 272/145 |
| 4,180,260 | 12/1979 | Slagle | 272/145 |
| 4,666,154 | 5/1987 | Lipscomb et al. | 272/144 |

FOREIGN PATENT DOCUMENTS

| | | | |
|---|---|---|---|
| 3417719 | 11/1985 | Fed. Rep. of Germany | 272/144 |

*Primary Examiner*—Stephen R. Crow

[57] ABSTRACT

A physical fitness device is provided which aids the user in performing sit-ups and other floor exercises. The device is comprised of two main members which fold together when not in use for ease of storage. Foot stirrups are used to anchor the feet and legs to the device while bending the upper torso toward the legs. Height adjustment of the device in relation to the floor is facilitated by moving guide posts which can be locked into place by cap screws. An optional seat is also provided for certain types of exercises.

3 Claims, 1 Drawing Sheet

TUMMY REDUCER

BACKGROUND OF THE INVENTION

This invention relates to an exercising apparatus and in particular to exercise boards that support the body in various positions relative to the floor.

The primary objective of this invention is to provide an apparatus that is useful in exercising the muscles in the midsection of the anatomy, thereby reducing the abdominal girth.

Another objective is to provide an apparatus that is convenient to use and is easily stored when not in use.

BRIEF SUMMARY OF THE INVENTION

The present invention describes an exercise slantboard comprised of two main members connected by a hinge with the larger member equipped with stirrups and heel straps and the smaller member having adjustable guide posts included in its body which can be used to change the height of the inclined surface from the floor. In addition, an adjustable seat is provided to keep the body in place when the fixture is used in the inclined position.

DESCRIPTION OF THE PREFERRED EMBODIMENT

Figure 1:
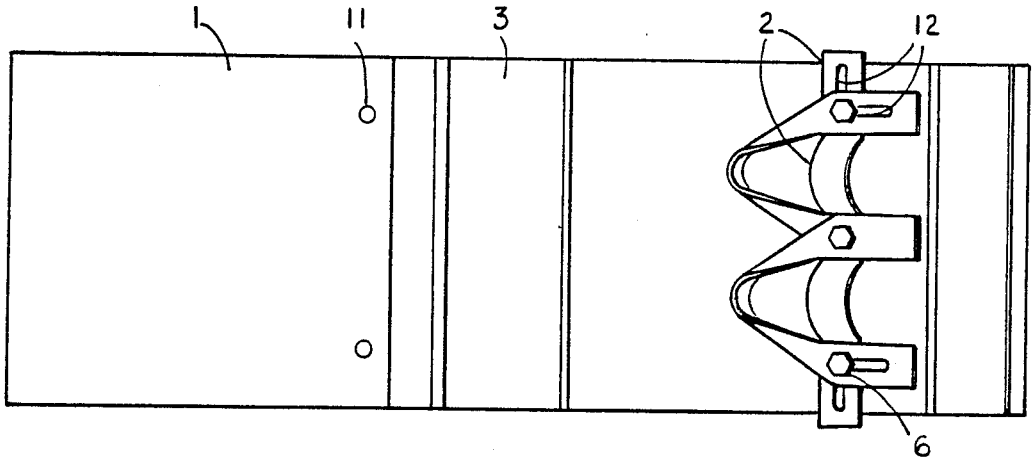
FIG. 1 is a top view of the invention showing the heel straps and stirrups.

Referring now to the drawings, FIG. 1 shows the connection of heel straps and stirrups 2 to a main frame 1 by means of fasteners 6. Slots 12 in heel straps and stirrups 2 allow adjustments in effective length of the straps and stirrups.

Figure 2:
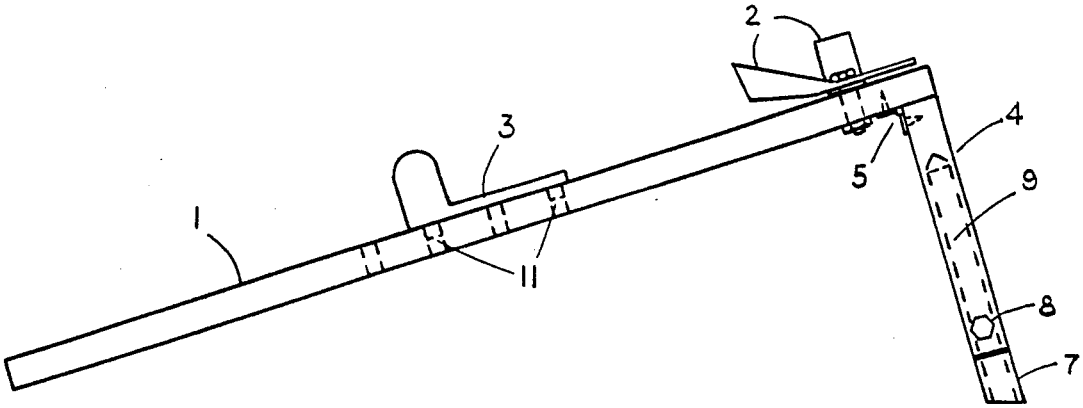
FIG. 2 is a side view which illustrates the relative position of the seat and stirrups.

FIG. 2 shows the connection of main frame 1 to a vertical support arm 4 by means of hinge 5. Seat 3 is attached to the main frame 1 by seat locating dowels 11. Cap screws 8 are used to lock guide posts 9 in position with the vertical support arm 4, thereby maintaining the desired position from the floor.

Figure 3:
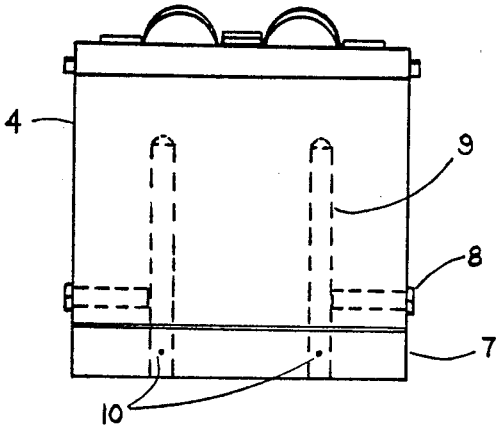
FIG. 3 is an end view which illustrates the adjustable guideposts used to change the height of the main frame.

FIG. 3 shows adjustable cross bar 7 attached to guide posts 9 by means of dowell pins 10. Guide posts 9 fit into cavities within the body of vertical support arm 4 thereby creating an adjustable base to support the main frame 1.

OPERATING DESCRIPTION OF THE FIXTURE

To use the device, main frame 1 and vertical support arm 4 are placed in a 90 degree position to each other by opening hinge 5 so that the device appears as shown in FIG. 2. Next, if seat 3 is being used for the desired exercise, it should be adjusted in a position that is compatible with the user's leg length by removing dowels 11 from one position and replacing them through the seat into a new position on main frame 1. The feet are now placed in position in the stirrups and heel straps 2 and are adjusted as required by loosening fasteners 6, repositioning straps 2 and tightening fasteners 6 with straps 2 in the desired position. If the height of main frame 1 needs to be adjusted, caps screws 8 can be loosened so that guide posts 9 can be moved in relationship to vertical support arm 4.

The device can now be used for a variety of exercises including those designed to reduce the abdominal girth.

What is claimed is:

1. An exercise device which provides an adjustable inclined surface for supporting the lower body of a user, comprising a main frame connected to a vertical support arm by hinge means, guide posts moveable within said vertical support arm to raise or lower said main frame, fastening means comprising threaded cap screws for holding said guide posts in a fixed position within said vertical support arm, and flexible straps attached to said main frame for holding a user's feet, said straps comprising a first strap for engaging a user's upper foot region, and a second strap for engaging a user's heel region, said straps having longitudinally extending elongated slots, said straps being adjustably secured to said main frame with threaded nuts and bolts whereby the effective length of said straps can be adjusted.

2. The invention, as defined in claim 1, which includes a seating means adjustable in position relative to said main frame.

3. The invention, as defined in claim 2, wherein said vertical support arm is a piece of solid material with cylindrical cavities formed in said material for the purpose of receiving said guide posts.

* * * * *